United States Patent [19]

Medow

[11] 3,968,610

[45] July 13, 1976

[54] FACING STRUCTURES FOR BUILDING

[76] Inventor: Robert S. Medow, 16000 Kelmarnock Drive, Miami Lakes, Fla. 33014

[22] Filed: Dec. 9, 1974

[21] Appl. No.: 530,827

[52] U.S. Cl. ..... 52/314; 52/539
[51] Int. Cl.[2] ..... E04D 3/361
[58] Field of Search ..... 52/539, 314

[56] References Cited

UNITED STATES PATENTS

| | | | |
|---|---|---|---|
| 525,442 | 9/1894 | Borrows | 52/539 |
| 569,002 | 10/1896 | Boehm | 52/539 |
| 2,039,536 | 5/1936 | Johnson | 52/314 |
| 2,279,382 | 4/1942 | Swenson | 52/539 |
| 2,359,845 | 10/1944 | Harshberger | 52/314 |
| 2,400,357 | 5/1946 | Krajci | 52/539 |
| 2,595,821 | 5/1952 | Turman | 52/539 |
| 3,217,453 | 11/1965 | Medow | 52/314 |
| 3,274,743 | 9/1966 | Blum | 52/539 |
| 3,613,326 | 10/1971 | Mollman | 52/314 |
| 3,621,625 | 11/1971 | Medow | 52/314 |

*Primary Examiner*—Ernest R. Purser
*Assistant Examiner*—Henry Raduazo
*Attorney, Agent, or Firm*—Salvatore G. Militana

[57] ABSTRACT

Facing structures for buildings simulating brick, stone, shingle and the like consisting of rectangular shaped panels of identical construction that interlock, overlap and abut with each other, each panel having a flange extending along its top and a first side edge that terminates in a wedge shaped edge portion that is received by a mating slot portion formed along the bottom and other side edge. The top and first side flanges are provided with openings for receiving rails that are overlapped by the edges of the adjoining panels along the slotted portions; the portion of these flanges along the tops of the panels not overlapped by the adjoining panels form a continuous mortar line while the portion of the flanges along the sides of the panels not overlapped form interrupted mortar lines.

1 Claim, 16 Drawing Figures

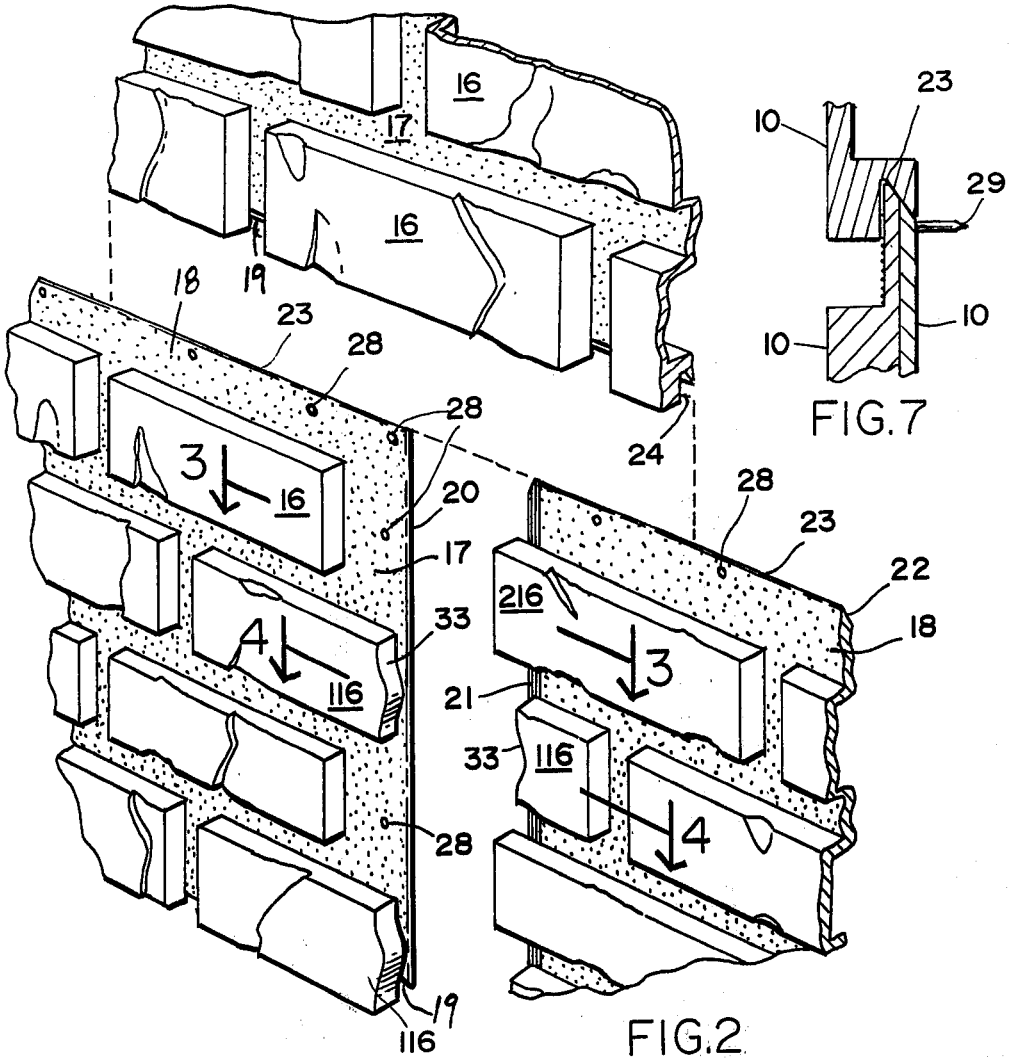
FIG.2
FIG.7
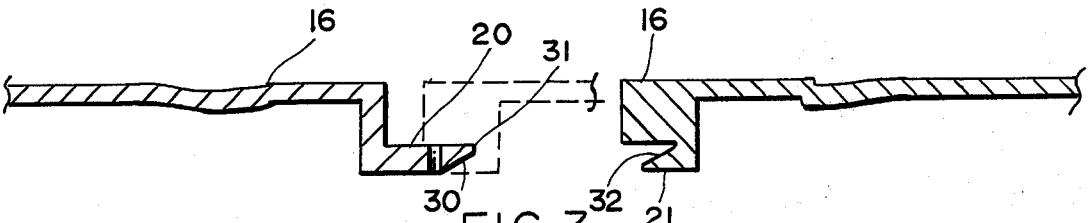
FIG. 3
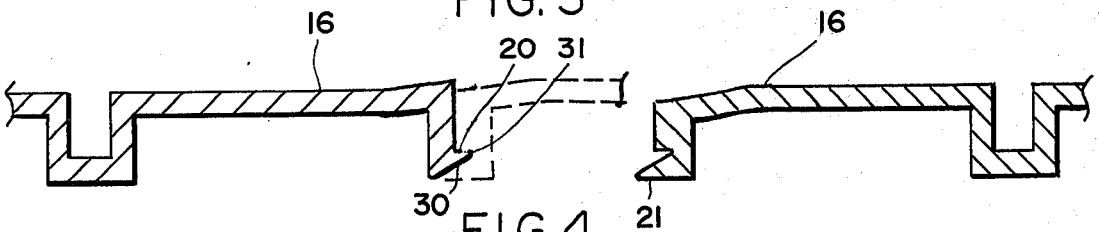
FIG.4

FACING STRUCTURES FOR BUILDING

CROSS REFERENCES TO RELATED PATENTS

This invention is an improvement of my U.S. Pat. No. 3,217,453, issued Nov. 16, 1965, for Facing Structure And Article, and U.S. Pat. No. 3,621,625, issued on Nov. 23, 1971 for Brick Siding.

BACKGROUND OF THE INVENTION

1. Field Of The Invention

This invention is directed to wall facings for buildings that utilize a minimum of material without affecting the proper simulation of brick, stone, shingle and the like.

2. Description Of The Prior Art

The present invention is an improvement over the applicant's prior U.S. Pat. Nos. 3,217,453 and 3,621,625. Both of these patents are directed to prefabricated fiberglass sidings for buildings consisting of identical rectangular panels that fit together and nailed to the wall of the building. The panels of each of these patents are provided with a flange along their top edge and along one side edge while the bottom edge and the other side edge are provided with a slot for receiving the flanges of an adjoining panel.

These flanges which were fastened to the wall of a building by nailing are hidden from view by an overlapping second flange extending in parallel and spaced relation to the first flange to cover the juncture of the flanges and the slots as well as cover the heads of the nails fastening the panels to the wall. The present invention avoids the use of both a nailing flange and a juncture covering flange, yet compelling the panels to be interlocked rather than just overlapping at the junctures of the panels, thereby not only resulting in a savings in materials in the manufacture of each panel, but also in fastening the panels more securely to the walls of a building.

SUMMARY OF THE INVENTION

Therefore, a principal object of the present invention is to provide a facing structure for buildings consisting of panels of identical construction which utilize less material than those of the conventional panels yet are more securely fastened in position by the interlocking of wedge shaped flanges and conforming slots formed along edges of the panels.

Another object of the present invention is to provide a facing structure for buildings consisting of panels which interlock and are weatherproof wherein rain flowing over the junctures of the panels cannot collect in slots formed by the interlocking structure of the panels and thereby improves the shedding of rain therefrom.

A further object of the present invention is to provide a facing structure for buildings consisting of panels that are readily fitted and nailed into position on the wall of the building to thereby reduce the cost of the labor in erecting the facing structure.

A still further object of the present invention is to provide a facing structure for buildings having brick panels of identical construction in which the brick that extend to the extreme edges of the panels either abut against a brick on the adjoining panel so that they appear as a single brick without a mortar joint, or the brick extends over the nail head of the adjoining panel to leave a mortar line between itself and the brick on the adjoining panel.

With these and other objects in view, the invention will be best understood from a consideration of the following detailed description taken in connection with the accompanying drawings forming a part of this specification, with the understanding, however, that the invention is not confined to any strict conformity with the showing of the drawings but may be changed or modified so long as such changes or modifications mark no material departure from the salient features of the invention as expressed in the appended claims.

BRIEF DESCRIPTION OF THE DRAWINGS

In the drawings:

FIG. 2 is an exploded view of portions of three panels at the position of their respective edge portions illustrating the manner of their overlapping and interlocking with one another.

FIGS. 3 and 4 are cross sectional views taken along the lines 3—3 and 4—4 respectively of FIG. 2, the dotted lines showing the positions of the panels when in engaged positions.

FIG. 7 is a cross sectional view taken along the line 7—7 of FIG. 6 showing the interlocking feature at the three panels.

DESCRIPTION OF THE PREFERRED EMBODIMENTS

Figure 1:
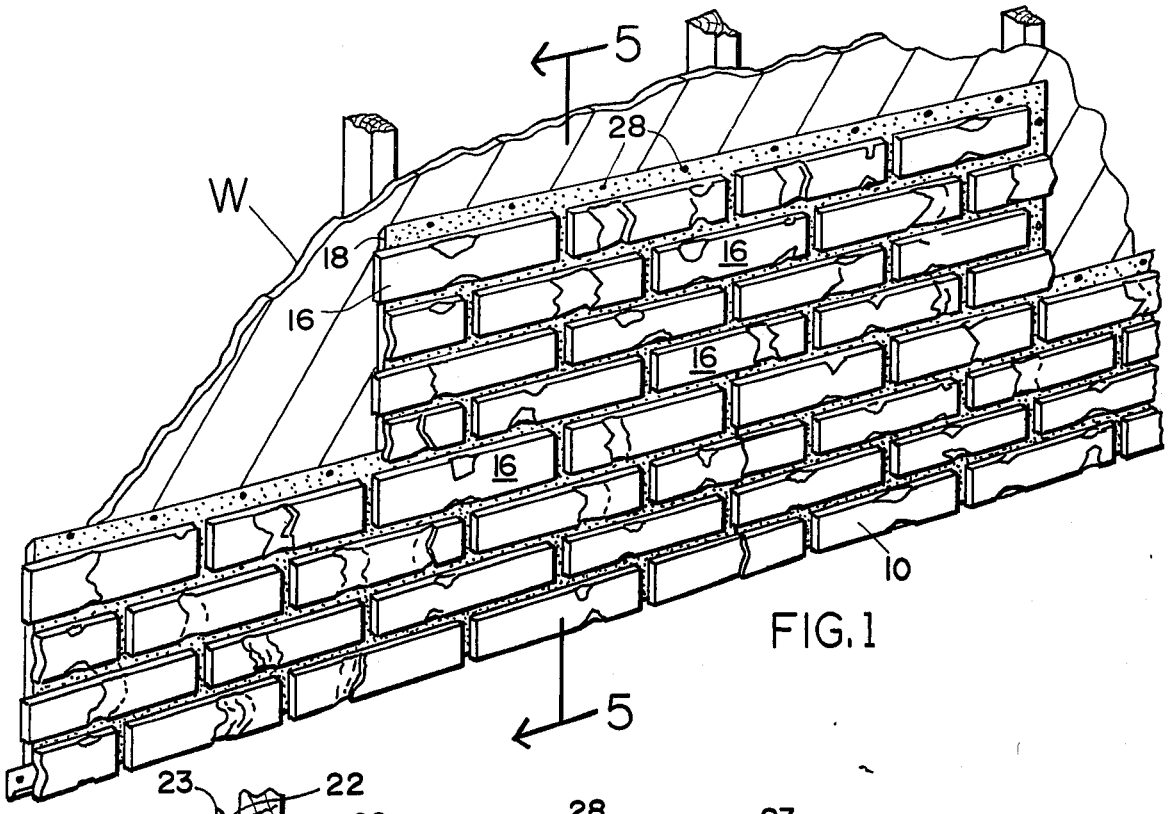
FIG. 1 is a fragmentary perspective view of a wall showing my siding and the manner of attaching same to the wall.
Figure 5:
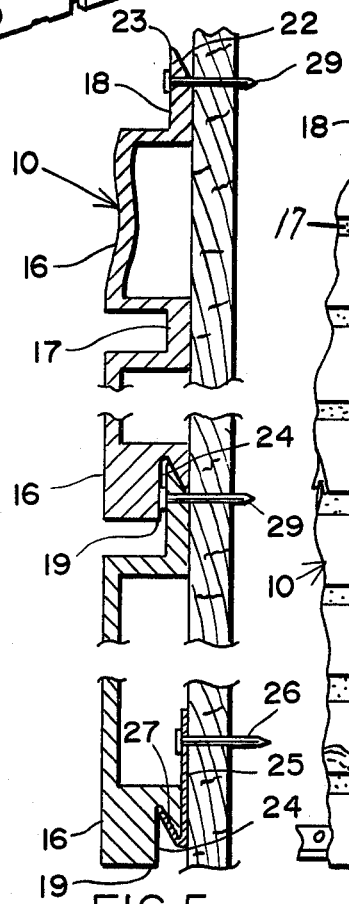
FIG. 5 is a cross sectional view taken along the line 5—5 of FIG. 1.
Figure 6:
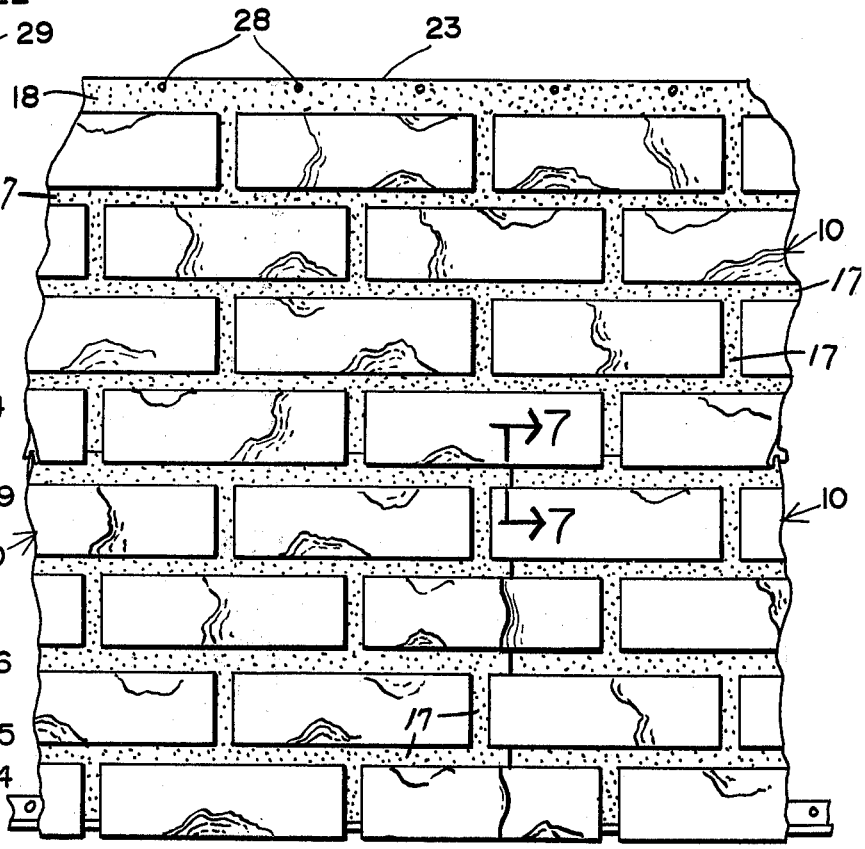
FIG. 6 is an enlarged view of that of FIG. 1 at the position of the juncture of three panels.
Figure 8:
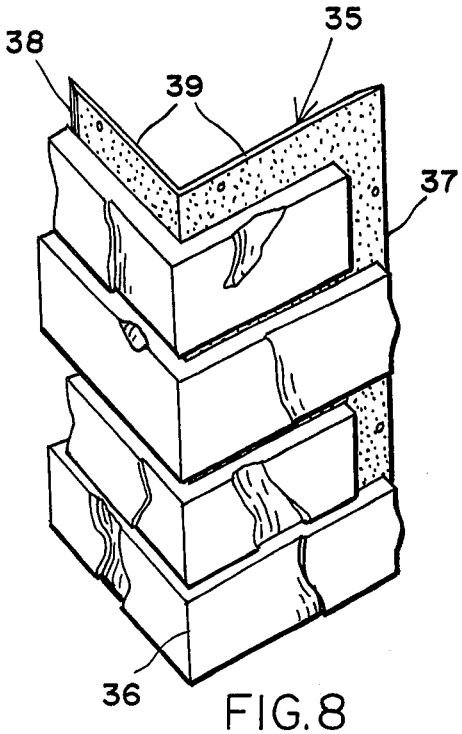
FIG. 8 is a perspective view of a corner facing.
Figure 9:
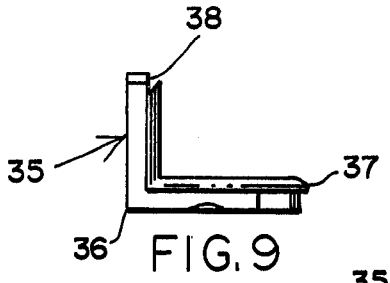
FIGS. 9, 10 and 11 are top plan and side elevational views thereof.
Figure 10:
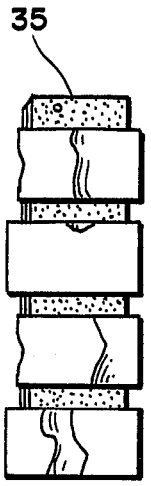
Figure 11:
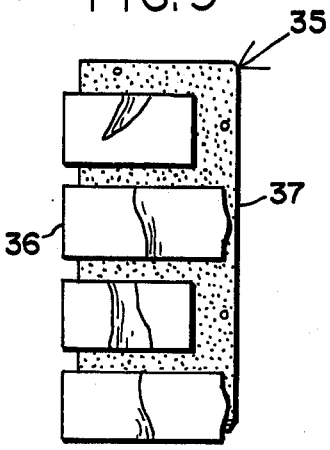
Figure 12:
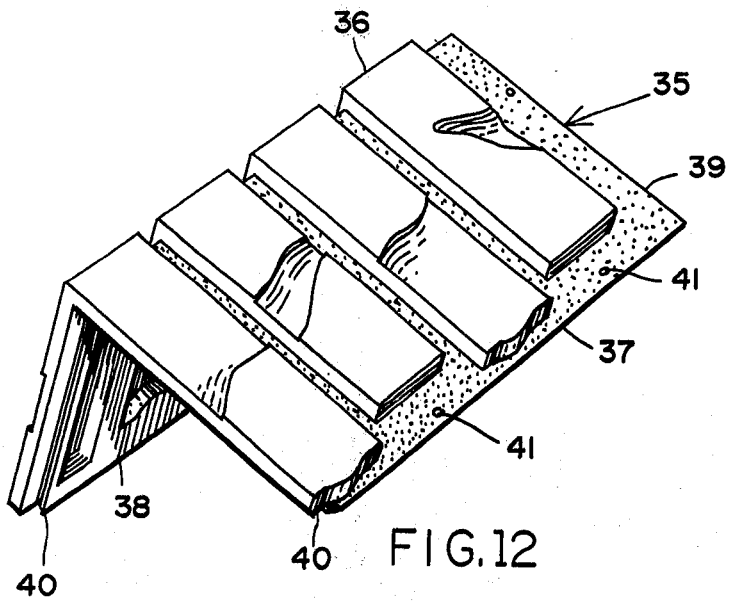
FIG. 12 is a perspective view similar to FIG. 8 as seen from the bottom edges of the corner facing.
Figure 13:
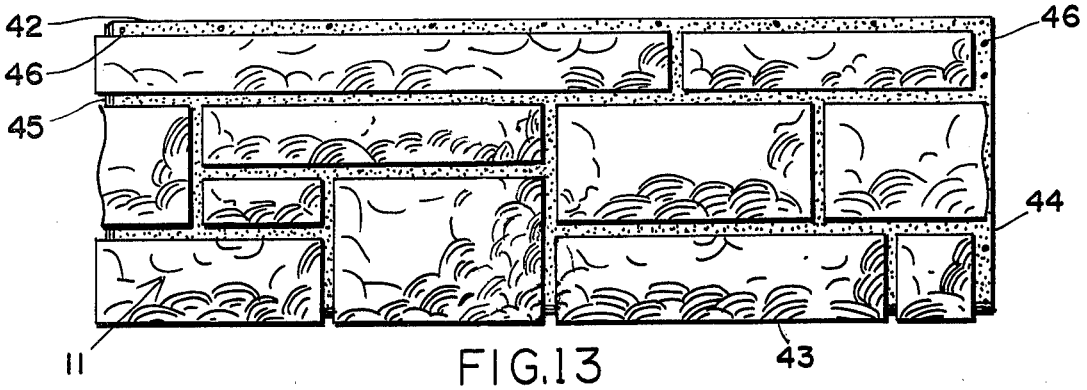
FIGS. 13–16 inclusive are front elevational views of various simulated kinds of wall facings embodying my invention.
Figure 14:
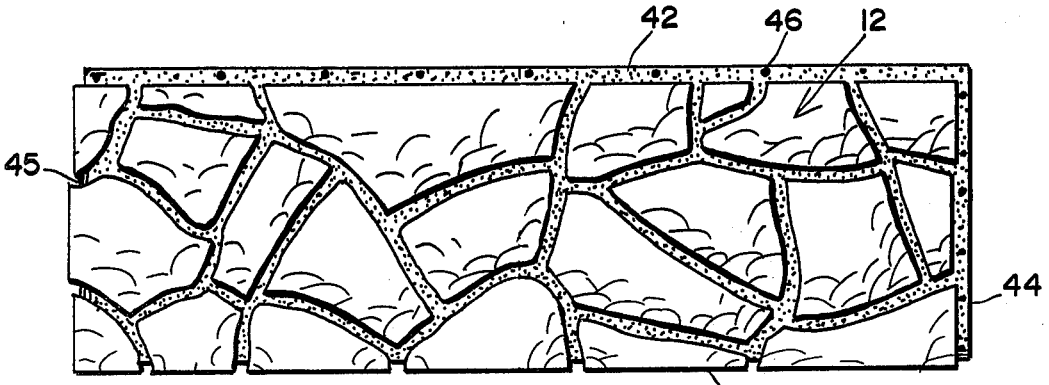
Figure 15:
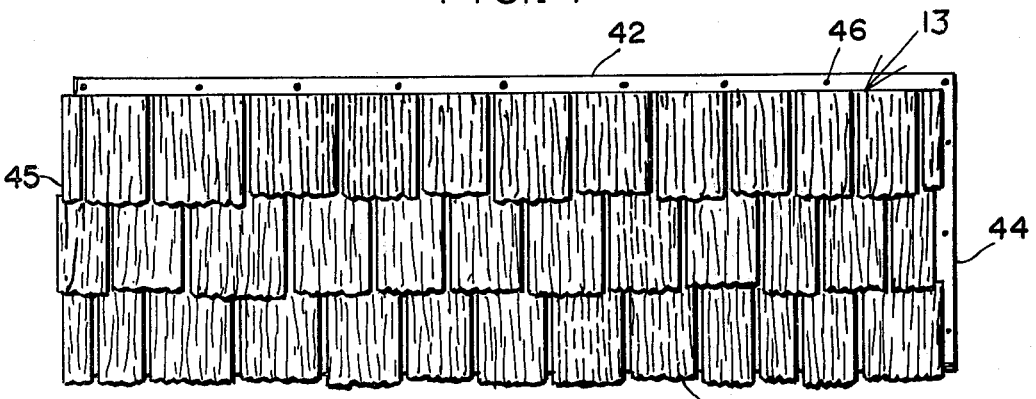
Figure 16:
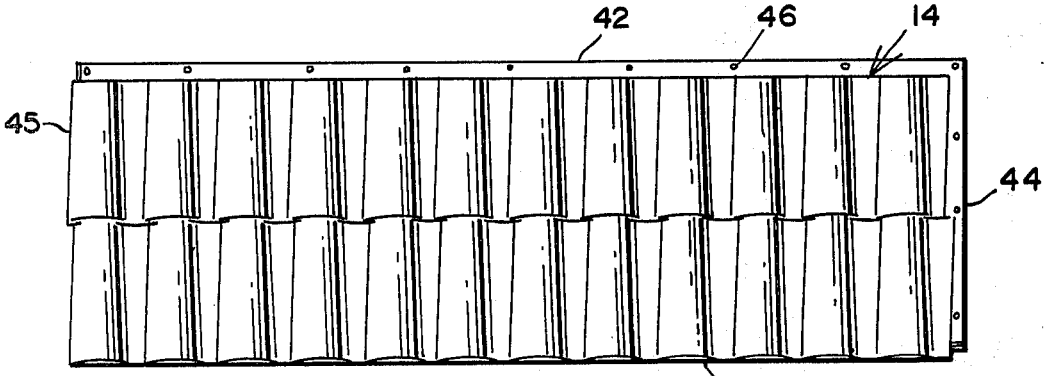

Referring to the drawings wherein like numerals are used to designate similar parts throughout the several views and in particular to FIGS. 1–5 inclusive, the numeral 10 refers to a single fiberglass panel constructed in accordance with my invention and is explained in detail hereinafter when fastened to a wall W in engaged abutting and overlapping relation with other like panels, the panels 10 form a watertight enclosure for the building. All of the panels 10 which are identical in construction with each other consist of an outer surface simulating antique, used or distressed brick as shown by FIGS. 1 and 6, rectangular and odd shaped stone 11 and 12 as shown by FIGS. 13 and 14, respectively, flat shingle as shown by FIG. 15 and barrel tile shingle 14 shown by FIG. 16.

Each of the panels 10 are rectangular in shape having its raised portions shaped to simulate brick 16 and mortar lines 17 in coplanar relation with a top edge portion 18, bottom edge portion 19, and side edge portions 20 and 21. The top edges 18 of each of the panels 10 are likewise made to simulate a mortar line, however, the free ends of these edge portions 18 are bevelled along their inner surface as at 22 to form a somewhat wedge shaped or knife edge portion 23 along the full length of the panel 10. At the bottom edge portion 19, the lowest line of simulated bricks 16 is undercut as at 24 in a form of a bevelled open slot for receiving and engaging the wedge shaped portion 23 of an adjacent panel 10 as illustrated best by FIG. 5. A metal retaining strip 25 which is fastened as by nails 26 to the bottom portion of the wall W is provided with an upwardly extending lip portion 27 that secures the bottom edge portion 19 of the lowermost line of panels 10 on the wall W of the building. Adjacent the bevelled portion 22 is a line of openings 28 for receiving nails 29 that fasten the panels 10 to the wall W. It is to be noted that when a pair of panels 10 are mounted on the wall W with their respective bottom and top edge portions 19 and 18 in engaged position, the upper panel 10 will overlap to the lower panel 10 at the position of the nail heads 29 to cover same and leave the remainder of the top edge flange 18 exposed as a mortar line in symmetry with the other mortar lines 17 on the panels 10.

The side edges 20 and 21 of each panel 10 are likewise provided with similar engaging and overlapping edges as the top and bottom edge portions 18 and 19. The side edge portion 20 is bevelled as at 30 along its inner surface to form a wedge shaped edge 31 which is received by a bevelled open slotted portion 32. Since the bricks of one line are in staggered relation with respect to the bricks of adjoining lines, some of the bricks 116 of one panel 10 will abut against an adjoining brick 116 of the adjacent panel 10. Both bricks 116 will have mating contoured free edges 33. The bricks 16 above and below the bricks 116 on the adjacent panels 10 will not abut with the brick 16 in the same line, but will leave a portion of the mortar line 17 exposed to view. At the position that the brick 216 which overlaps the adjacent panel 10, there will be formed openings 28 to receive nails 29 that remain concealed by the overlapping bricks 216. At the position of the abutting bricks 116, there will obviously be no mortar line so that when a number of interengaging panels 10 have been fastened properly on the wall W the edges 18, 19, 20 and 21 of the panels 10 will be interlocked by the bevelled or wedge shaped edges 23 and 31 received by the slots 24 and 32 respectively, the bricks 116 will be in abutting relation while the brick 216 will extend over the nail openings 28 and thereby overlap the adjacent panel 10.

The interengagement of the adjoining panels 10 by the aforesaid flange and slot arrangements on each side of the panels maintain the panels 10 in a coplanar and secured relation as do the abutting and overlapping bricks to thereby increase the fastening effect of the panels 10 to the wall. This effect is especially noted at the juncture of three panels 10 as illustrated best by FIGS. 6 and 7, the three panels 10 consisting of two panels 10 in side by side relation and the third panel 10 extending across both lower panels 10. The adjacent vertical edge portions 21 and 20 of panels 10 engage together as shown by the dotted line portions in FIGS. 3 and 4, while the horizontal wedge shaped edge portions 23 of the two lower panels 10 are received by the slotted portion 23 of the upper panel 10 as shown by FIG. 7, the three panels 10 becoming interlocked thereby.

FIGS. 8–12 inclusive illustrate corner panels 35 that are adapted to be fastened to a building wall at the corners to permit the panels 10 to be interlocked therewith. These corner panels 35 are in effect a pair of panels that are identical in construction with the panels 10 except that the panels are joined at right angle along one edge portion as at 36.

As with the afore described panels 10, a vertical edge portion 37 on one side of the corner panel 35 is identical to the wedge shaped flange 20 of the panel 10 and the other vertical edge portion 38 is identical to the slotted edge portion 21. The top horizontal edge portion 39 is wedge shaped and identical in shape and size to the flange 23 of the panels 10 while the lower edge portion 40 is slotted as at 24 of the panels 10. The corner panels 35 interengage with the panels 10 in the same manner as the panels 10 interengage with each other and described in detail hereinabove. Also, openings 41 are provided for receiving nails for fastening the corner panels 35 to the wall W at the corners thereof, the nail holes 41 being covered by the edges portions of the adjacent panels 10.

FIGS. 13–16 inclusive illustrate the use of my interlocking system, as explained above, of my panels 10 as applied to the panels 11, 12, 13 and 14 which have their outer surfaces contoured to simulate facing members of different materials such as stone, shingles, etc. Each of these panels 11–14 inclusive are provided with identical interlocking edge portions as are described in detail in connection with the panels 10. The top edge portions 42 of each of these panels 13–16 inclusive are wedge shaped flanges identical to the wedge shaped flange 23 of the panels 10; the bottom edge portions 43 being identical to the bottom slotted portion 24 of the panels 10; the side edge portion 44 being identical to the wedge shaped edge portion 20 of the panels 10 and the other side edge portion 45 being identical to the slotted edge portion 32 of the panels 10. The panels 11–14 inclusive which are nailed to a wall through openings 46 and are made to interengage with its mating panels in the same manner as explained hereinabove.

What I claim as new and desire to secure by Letters Patent of the United States is:

1. A facing panel structure for walls of a building comprising a plurality of sheets of substantially rectangular material whose outer surface is contoured for simulating at least one of various construction facing materials, positioned thereon in spaced relation with each other and with mortar line portions simulated between said construction material, each of said sheets having flange portions extending along its edge portions, said flange portions of a top edge portion and one side edge portion of each of said sheets of material having an inclined inner wall portion forming a wedge shape, said inclined inner wall portion having an opening in substantially close proximity to said wedge shaped portions for receiving a fastening member therethrough, said flange portions of a bottom edge portion and the other side of said sheet of material having an inclined outer wall portion forming a mating slot substantially identical in shape and size with said wedge shaped flange portions, said simulated construction material of said sheets extending beyond said inclined outer wall portion, said simulated mortar line portion extending beyond said inclined inner wall portion and lying in a plane stepped inwardly of said simulated construction facing material, whereby upon mounting said sheets of material on said wall, said wedge shaped flanges of one sheet are received by said mating slots of adjoining sheets of material, and fastening members extending through said openings for securing said sheets of material to said wall, and said extended simulated construction material extending over said fastening members whereby said inclined outer wall portion of one sheet engages said outer wall portion of an adjacent sheet in proximity of said fastening members.

* * * * *